US011690436B2

(12) United States Patent
Jusic

(10) Patent No.: US 11,690,436 B2
(45) **Date of Patent: *Jul. 4, 2023**

(54) BAG WITH REMOVABLE PANEL

(71) Applicant: CaseConcept, LLC, Carson, CA (US)

(72) Inventor: Alis Jusic, Carson, CA (US)

(73) Assignee: CaseConcept, LLC, Carson, CA (US)

( * ) Notice: Subject to any disclaimer, the term of this patent is extended or adjusted under 35 U.S.C. 154(b) by 87 days.

This patent is subject to a terminal disclaimer.

(21) Appl. No.: 17/225,751

(22) Filed: Apr. 8, 2021

(65) Prior Publication Data

US 2021/0219704 A1 Jul. 22, 2021

Related U.S. Application Data

(63) Continuation-in-part of application No. 16/732,490, filed on Jan. 2, 2020, now Pat. No. 11,000,108.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 3/04; A45F 2003/001; A45F 2003/003; A45F 3/042; A45F 4/02; A45C 13/08; A45C 13/103; A45C 13/001; A45C 3/08; A45C 13/002
See application file for complete search history.

(56) References Cited

U.S. PATENT DOCUMENTS

| | | | | |
|---|---|---|---|---|
| 2,723,696 | A * | 11/1955 | Kase | A45C 13/08 150/105 |
| 4,085,873 | A * | 4/1978 | Schweitzer | A45C 7/0077 294/142 |
| 7,617,956 | B1 | 11/2009 | Sabbah | |
| 9,004,760 | B2 | 4/2015 | Tzortzis | |
| 9,302,162 | B1 | 4/2016 | Foxman | |
| 9,433,278 | B2 * | 9/2016 | Donahue | A45F 3/04 |
| 9,474,355 | B1 | 10/2016 | Chadwick et al. | |
| 9,986,813 | B2 | 6/2018 | Nakamura | |
| 2007/0137959 | A1 | 6/2007 | Zauderer | |
| 2009/0206118 | A1 | 8/2009 | Sabbah | |
| 2012/0097495 | A1 | 4/2012 | Moore | |
| 2013/0032502 | A1 | 2/2013 | Anderson et al. | |
| 2017/0143083 | A1 * | 5/2017 | Eyal | A45C 13/1069 |
| 2018/0042325 | A1 | 2/2018 | Regan | |
| 2019/0082817 | A1 * | 3/2019 | Ji | A45F 3/04 |
| 2019/0380474 | A1 | 12/2019 | Austin | |
| 2020/0077771 | A1 | 3/2020 | Jones et al. | |
| 2020/0170362 | A1 * | 6/2020 | Xie | A45C 13/08 |

* cited by examiner

*Primary Examiner* — Adam J Waggenspack
(74) *Attorney, Agent, or Firm* — Endurance Law Group PLC

(57) ABSTRACT

A bag (e.g., backpack) having a removable panel. The removable panel may be releasably and selectively coupled to the bag using various mechanisms, such as hook-and-loop fasteners, zippers, magnets, clasps, clamps, hooks, buckles, snaps, and buttons. The removable panel acts as the front face of the bag when it is coupled to the bag.

19 Claims, 8 Drawing Sheets

BAG WITH REMOVABLE PANEL

PRIORITY CLAIM

This continuation-in-part patent application claims priority to and the benefit of the filing date of U.S. nonprovisional patent application having application Ser. No. 16/732,490, filed on Jan. 2, 2020, which is incorporated herein in its entirety.

FIELD

The present disclosure relates to a bag, such as a backpack, having a removable panel.

BACKGROUND

People enjoy accessorizing and stylizing their clothes, shoes, hats, and any other personal belongings/accessories to their individual preferences. Some people may want their clothes, shoes, hats, etc. to match their bags/packs on any given day and for any occasion. For example, an individual wearing brown shoes with a brown belt on Monday may also want their bag to be have a brown face to match the rest of their outfit. The same individual may want to wear red shoes with a red belt on Tuesday, while having a bag that also matches this outfit, without needing to buy a different bag.

Others may want to display their favorite sports teams, businesses, universities, etc. on the face of their bags without needing to purchase a separate bag for each team, university, etc. The attachment of pins, patches, buttons, stickers, and the like to bags often results in a low-cost, unprofessional, and unsophisticated look. In addition, these objects typically do not evenly cover the face of a bag and may be unintentionally or accidently removed. Many bags, though, have appearances that cannot be easily changed or varied.

As a result, there is a need for a bag with a front/face panel that may be readily stylized and replaced to meet an individual's personal preferences while maintaining the bag's overall utility.

SUMMARY

The present disclosure describes, among other things, a bag (e.g., backpack) having a removable panel. The removable panel may be releasably connected to the bag using various mechanisms.

In an embodiment, the backpack includes a top side having one or more first fasteners; a bottom side; a front side having a first end and a second end, wherein the second end is proximate to the top side, wherein the front side includes one or more second fasteners, and wherein the second fasteners extend vertically from the first end to the second end of the front side; and a back side opposite the front side. The backpack also includes a removable panel having a first side and an opposing second side, wherein the first side includes one or more third fasteners; wherein the removable panel is selectively coupled to an exterior surface of the front side when the one or more third fasteners on the removable panel are aligned and engaged with the one or more first fasteners on the top side and/or the one or more second fasteners front side; and wherein the first side of the removable panel rests flush against the front side and at least partially extends over the top side.

In some embodiments, the one or more first fasteners on the top portion, the one or more second fasteners on the front side, and the one or more third fasteners on the removable panel comprise strips of Velcro (i.e. hook-and-loop fasteners). The strips of hook-and-loop fastener on the third fasteners are aligned with and affixed to the strips of hook-and-loop fastener on the top portion and the front side when the removable panel is coupled to the front side.

In other embodiments, the one or more first fasteners on the top portion comprise one or more first magnets, the one or more second fasteners on the front side comprise a first set of zipper teeth, and the one or more third fasteners on the removable panel comprise one or more second magnets inserted therein and a second set of zipper teeth. The removable panel also includes a zipper slider is coupled to the second set of zipper teeth. The first set of zipper teeth is engaged with the second set of zipper teeth using the zipper slider when the removable panel is coupled to the front side. Also, the one or more first magnets are aligned with and attracted to the one or more second magnets when the removable panel is coupled to the front side.

In yet other embodiments, each of the one or more first fasteners on the top portion and the one or more second fasteners on the front side comprises one or more first magnets inserted therein, respectively. The one or more third fasteners on the removable panel comprise one or more second magnets inserted therein. The one or more first magnets are aligned with and attracted to the one or more second magnets when the removable panel is coupled to the front side.

In an alternative embodiment, a backpack includes a top side including one or more first fasteners; a front side; a back side opposite the front side, wherein the back side includes shoulder straps; a left side and an opposing right side, wherein at least one of the left side and the right side includes one or more second fasteners; and a removable panel having a first side and an opposing second side. The first side of the removable panel includes one or more third fasteners; wherein the third fasteners on the removable panel are selectively engaged with one or more of the first fasteners on the top side and with the one or more of the second fasteners; and wherein at least a portion of the first side of the removable panel extends over at least a portion of the top side.

BRIEF DESCRIPTION OF THE DRAWINGS

The above, as well as other advantages of the present disclosure, will become readily apparent to those skilled in the art from the following detailed description when considered in light of the accompanying drawings in which.

and

Figure 13:
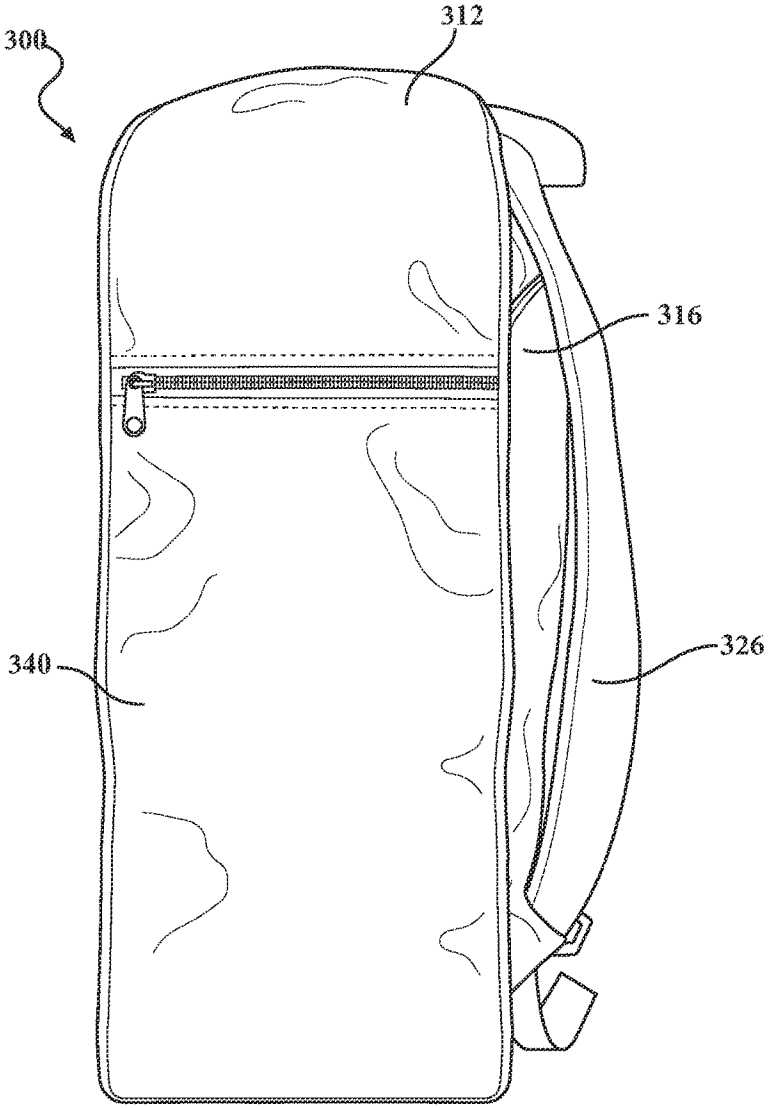
FIG. 13 is a schematic side elevation view of the backpack illustrated in FIG. 12.
Figure 12:
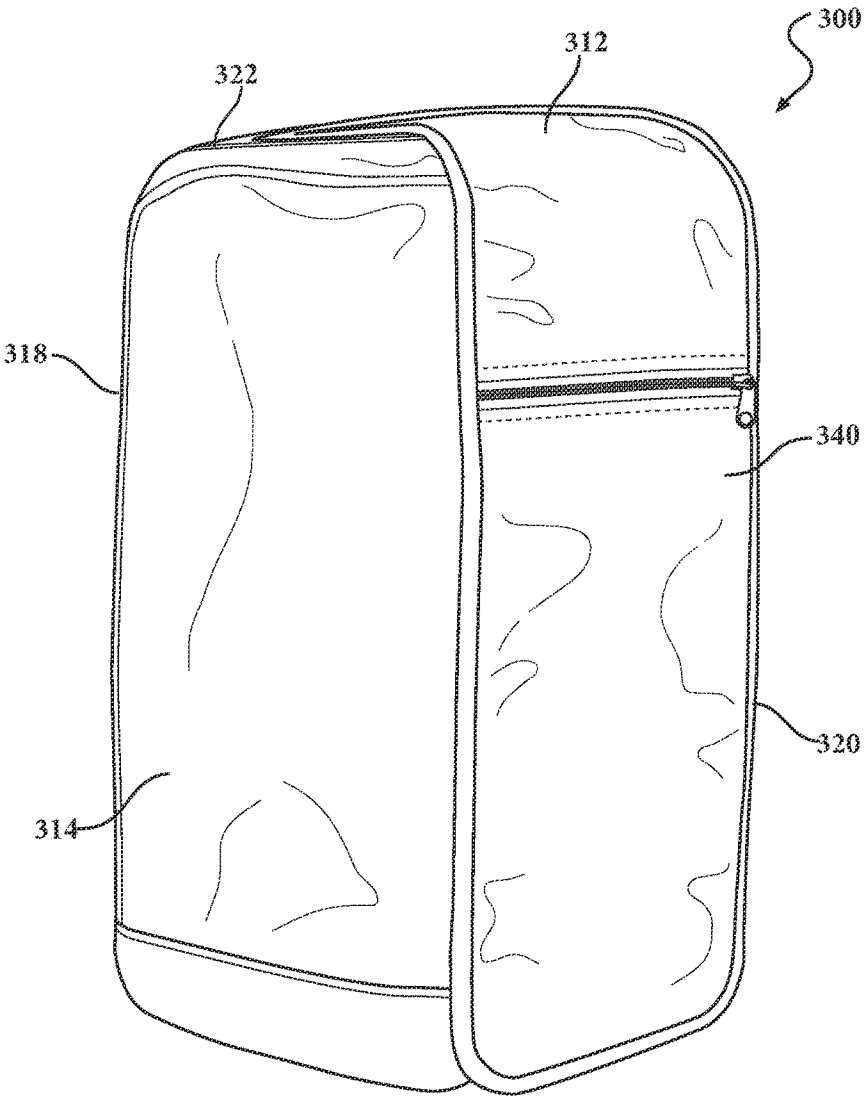
FIG. 12 is a schematic perspective view of a backpack according to yet another alternative embodiment of the disclosure, wherein a removable panel is coupled to the backpack.
Figure 15:
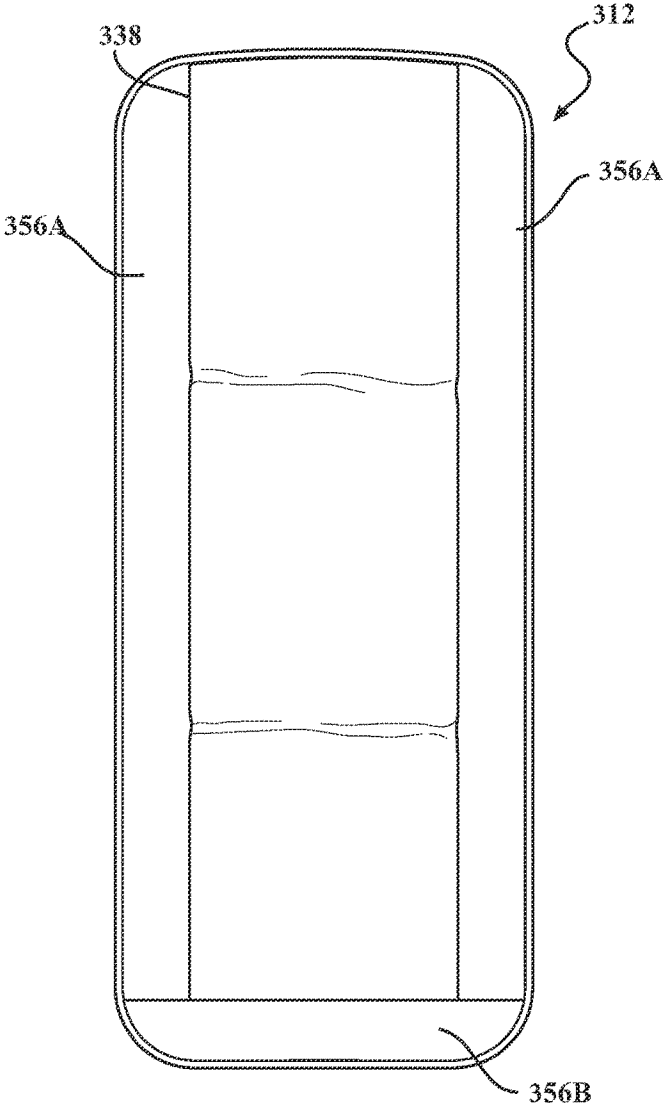
Figure 14:
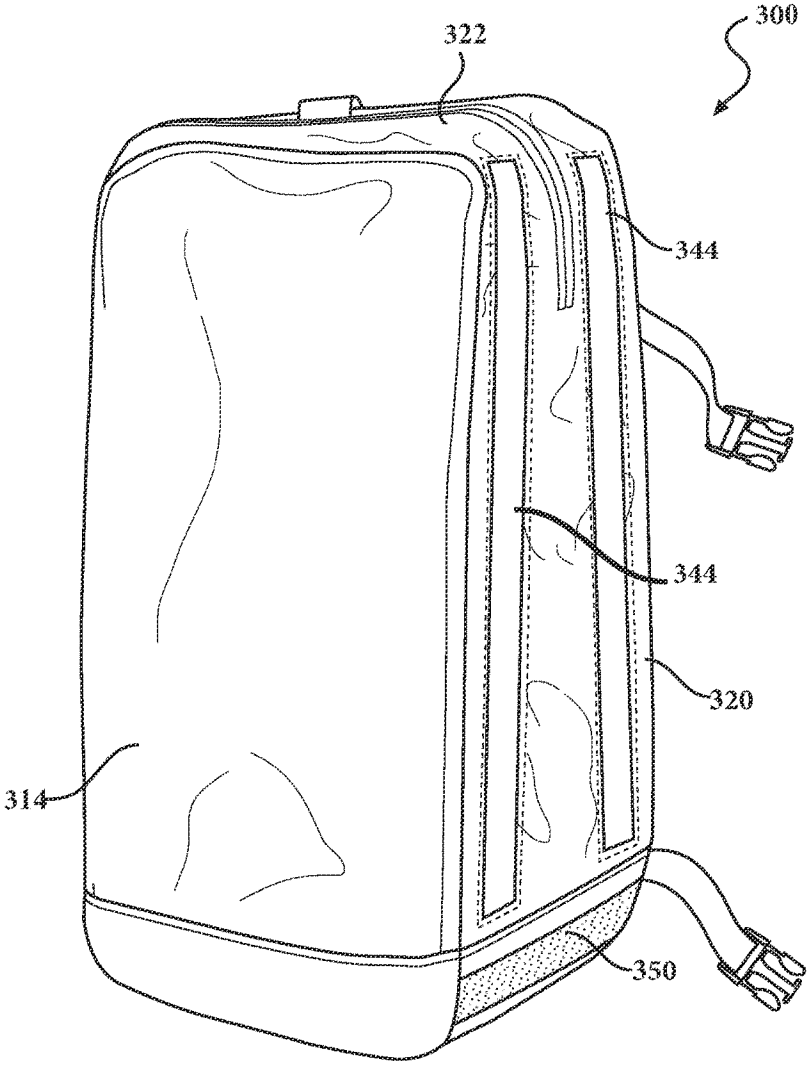

FIG. 14 is a schematic perspective view of the backpack illustrated in FIGS. 12 and 13 without the removable panel; and FIG. 15 is a schematic elevation view of a removable panel that couples with the backpack illustrated in FIGS. 12-14.

DETAILED DESCRIPTION

It is to be understood that the disclosure may assume various alternative orientations and step sequences, except where expressly specified to the contrary. It is also understood that the specific devices and processes illustrated in the attached drawings, and described in the specification are simply exemplary embodiments of the inventive concepts disclosed and defined herein. Hence, specific dimensions, directions or other physical characteristics relating to the various embodiments disclosed are not to be considered as limiting, unless expressly stated otherwise.

The use of any and all examples, or exemplary language herein, for example, "such as" or "including," is intended merely to better illustrate the present teachings and do not pose a limitation on the present disclosure unless claimed. No language in the present disclosure should be construed as indicating any non-claimed element as essential to the practice of the present disclosure.

In general, this disclosure describes a bag (e.g. backpack or duffle-style bag) that has a removable panel. Even though a backpack is illustrated in the figures of the present disclosure, one of ordinary skill in the art would understand that other types of bags, such as duffle bags, pouches, sports bags, messenger bags, camera bags, cosmetic bags, travel bags, wheeled bags, or any other type of bag, may also be used with the present disclosure. The removable panel may be the front/face portion of the bag, which may be readily removed from and attached to the bag.

FIGS. 1-7 illustrate views of a backpack 10 according to a first embodiment of the disclosure. The backpack 10 includes a removable panel 12 coupled to a front side 14 on the backpack 10 and a back side 16 that generally opposes the front side 14. The backpack 10 also includes opposing left and right sides 18, 20, a top portion 22, and a bottom portion 24. In addition, the backpack 10 includes adjustable shoulder straps 26 that extend across the back side 16 (e.g. FIG. 4), an inner compartment accessible by a first zipper 30 on the back side 16 (e.g. FIG. 4), another inner compartment accessible by a second zipper 32 extending across the top portion 22 (e.g. FIG. 5), a plurality of pockets 28 on the exterior surface of the left and right sides 18, 20 (e.g. FIGS. 1, 3, and 5), and one or more locking clips 34 extending outward from the back side 16 (e.g. FIG. 4). In an embodiment, the backpack 10 may also include a locking mechanism 36 on the top portion 22. In other embodiments, the backpack 10 may include other elements and structures that are not depicted in the drawings.

The backpack 10 may be made from any suitable fabric or material, including, but not limited to cloth, leather, nylon, metal, mesh, fur, vinyl, silk, cotton, polyester, etc. Similarly, the removable panel 12 may be made from the same types of materials as the backpack 10.

FIGS. 1-4 illustrate the removable panel 12 selectively coupled to the front side 14 such that the removable panel 12 acts as a front face on the backpack 10. The removable panel 12 may be readily interchangeable with a variety of different bags depending on the user's preferences. In this embodiment, the removable panel 12 is selectively coupled to an exterior surface of the front side 14 of the backpack 10 using one or more VELCRO® strips 44, 50 positioned on the front side 14 and one or more VELCRO® strips 56 positioned on a first side 38 of the removable panel 12. The VELCRO® strips 44, 50, 56 may each be secured to the front side 14 of the backpack 10 and the first side 38 of the removable panel 12 using various techniques, such as sewing, gluing, taping, etc. This allows the first side 38 of the removable panel 12 to rest flush with front side 14 of the backpack 10 when coupled.

Figure 5:
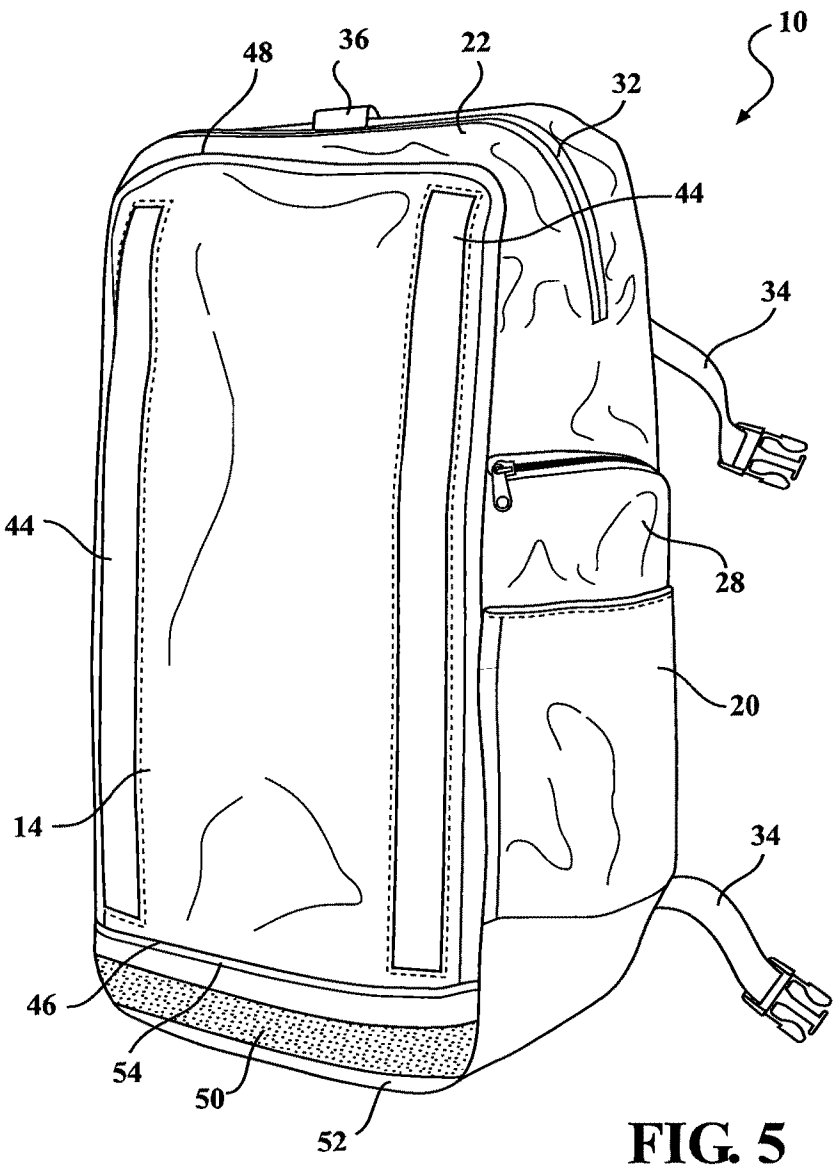
FIG. 5 is a schematic perspective view of the backpack illustrated in FIGS. 1-4 without the removable panel.
Figure 4:
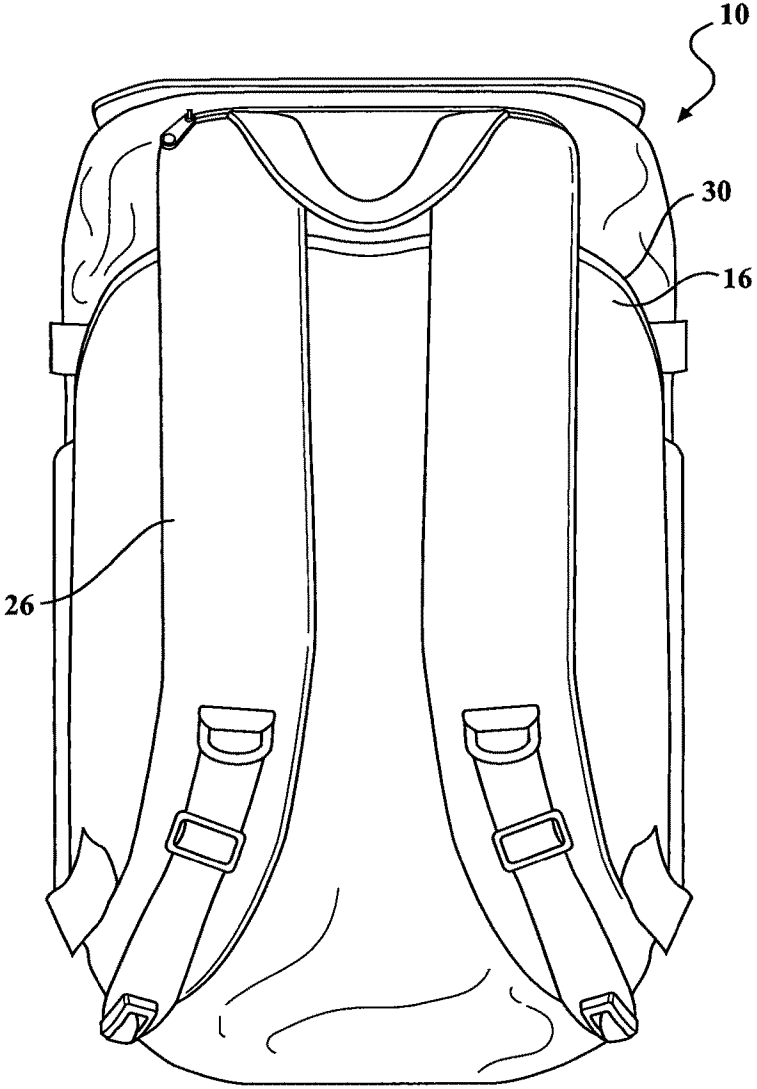
FIG. 4 is a schematic rear view of the backpack illustrated in FIGS. 1-3.

In the embodiment shown in FIG. 5, two parallel strips 44 of VELCRO® may each extend vertically along the entire length of the exterior surface of the front side 14 of the backpack 10 from a first end 46 of the front side 14 to a second end 48 of the front side 14. The second end 48 of the front side 14 is proximate to the second zipper 32. The two parallel strips 44 of VELCRO® may each also extend at least partially across the top portion 22 between the second zipper 32 and the back side 16. One of ordinary skill in the art would understand that the strips 44 of VELCRO® may extend only partially along the exterior surface of the front side 14 of the backpack 10 in other embodiments. Also, one of ordinary skill in the art would understand that there may be only one strip or more than two strips of VELCRO® extending at least partially along the front side 14 of the backpack 10.

In the embodiment shown in FIG. 5, the front side 14 of the backpack 10 also includes another strip 50 of VELCRO® positioned at a bottom portion 52 of the front side 14. The strip 50 of VELCRO® is perpendicular to and thicker than the strips 44 of VELCRO® located on the front side 14. The strip 50 of VELCRO® may be positioned directly on the exterior surface on the bottom portion 52 of the front side 14 or on a flap portion 54 positioned on the bottom portion 52 of the front side 14.

Figure 6:
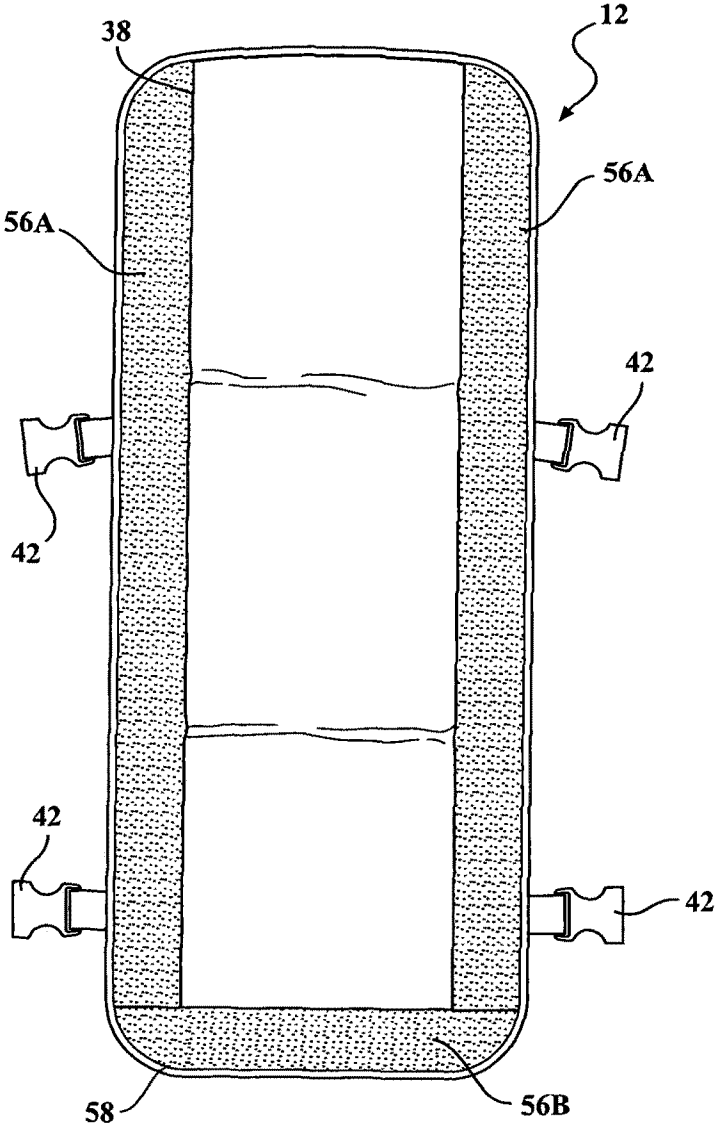
FIG. 6 is a schematic elevation view of a side of the removable panel illustrated in FIGS. 1-4.

As best seen in FIG. 6, the first side 38 of the removable panel 12 may comprise VELCRO® strips 56 that are configured to mate with the one or more of the VELCRO® strips 44 on the front side 14 of the backpack 10. In the embodiment shown in FIG. 6, there is a set of parallel VELCRO® strips 56A arranged along the outer portions of the first side 38 of the removable panel 12 and a VELCRO® strip 56B positioned perpendicular to the set of parallel VELCRO® strips 56A. The VELCRO® strip 56B shown in FIG. 6 is located on a lower portion 58 of the first side 38 of the removable panel 12 to properly align with the VELCRO® strips 44, 50 located on the front side 14 of the backpack 10. One of ordinary skill in the art would understand that the location and quantity of VELCRO® strips on the first side 38 of the removable panel 12 may vary in other embodiments.

Figure 1:
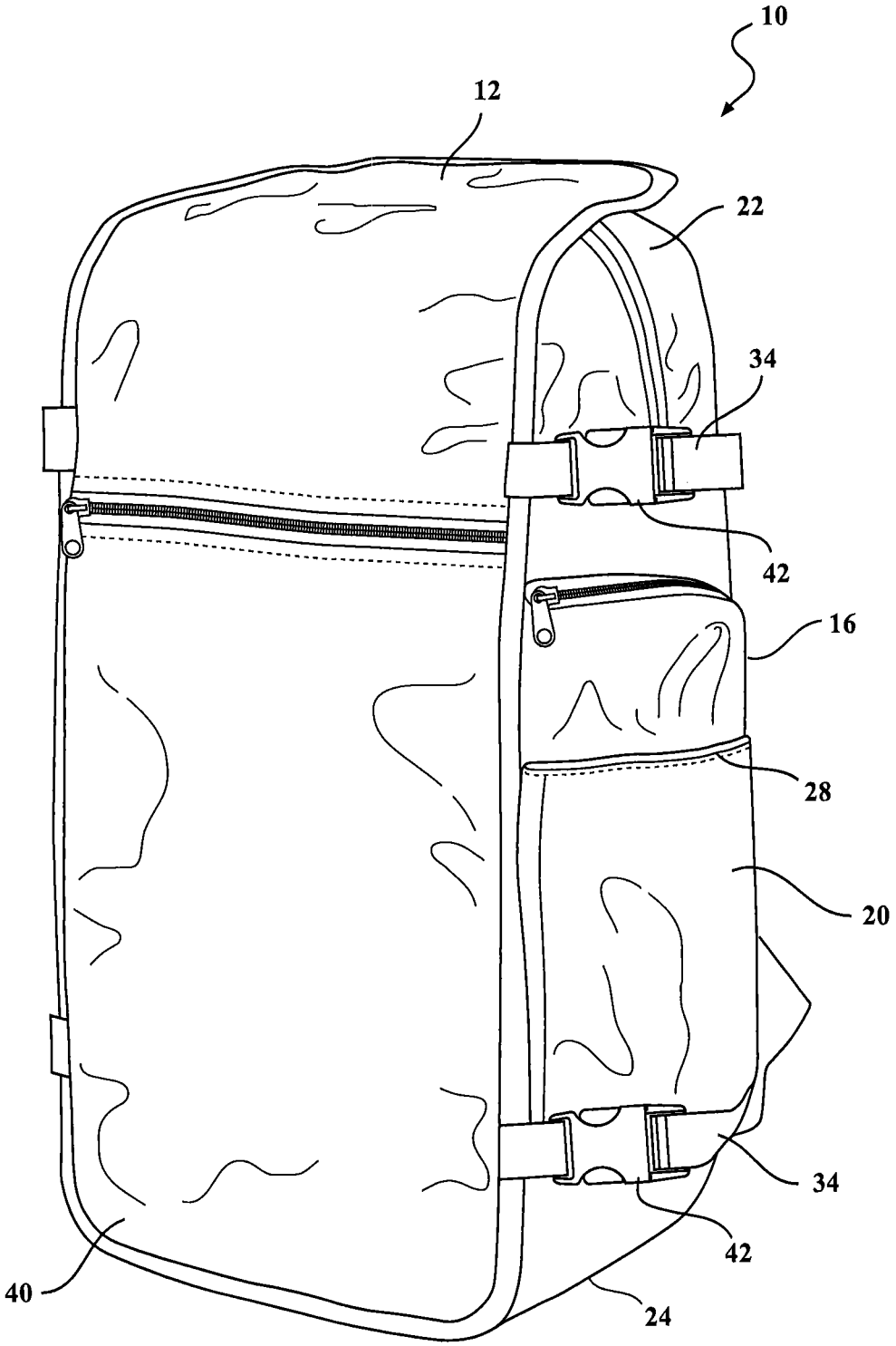
FIG. 1 is a schematic perspective view of a backpack according to an embodiment of the disclosure, wherein a removable panel is coupled to the backpack.
Figure 3:
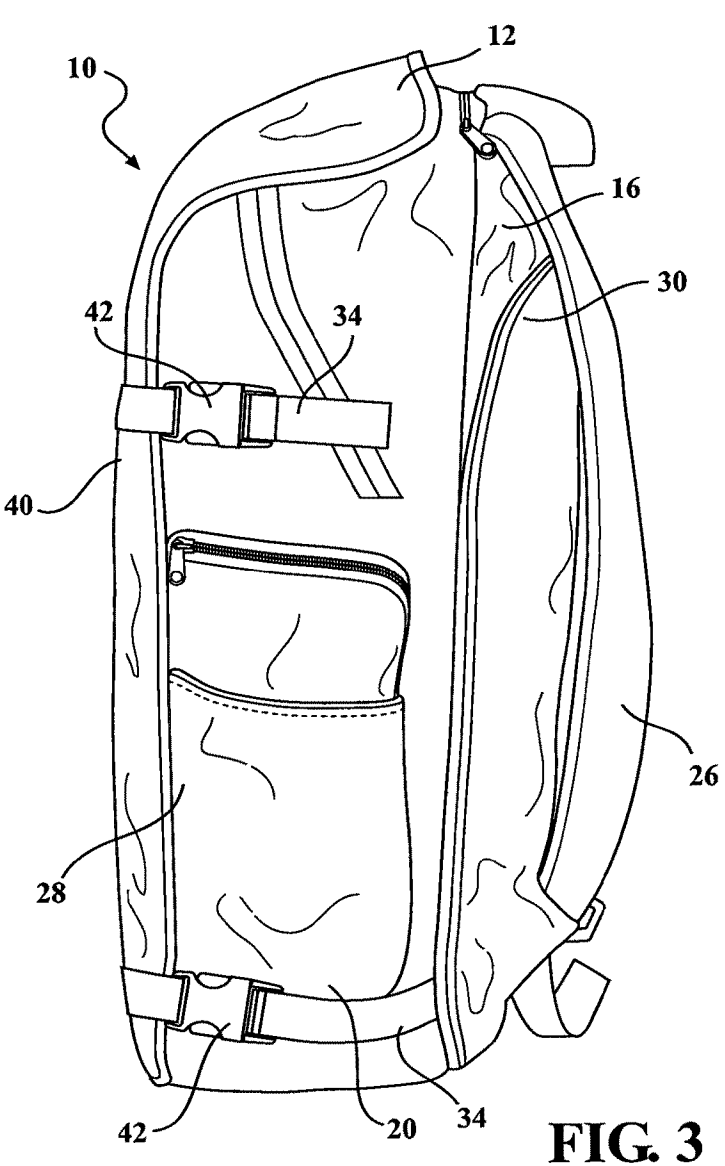
FIG. 3 is a schematic side elevation view of the backpack illustrated in FIGS. 1 and 2.
Figure 2:
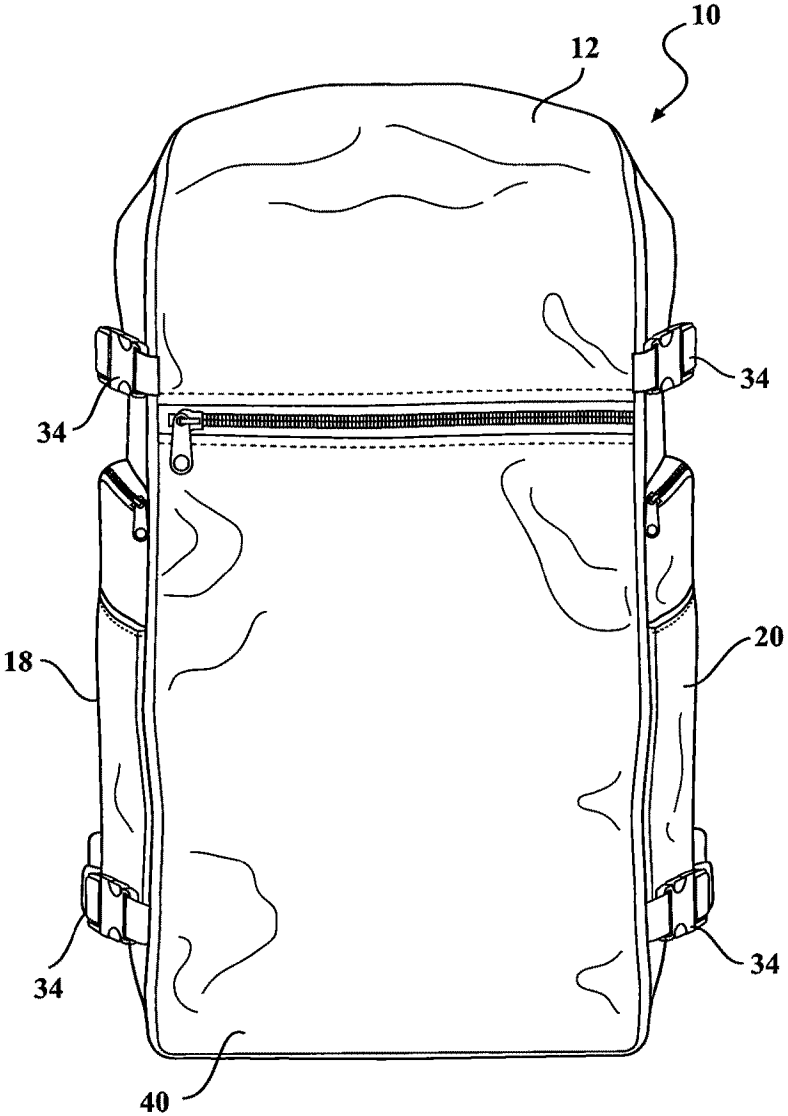
FIG. 2 is a schematic front elevation view of the backpack illustrated in FIG. 1.
Figure 7:
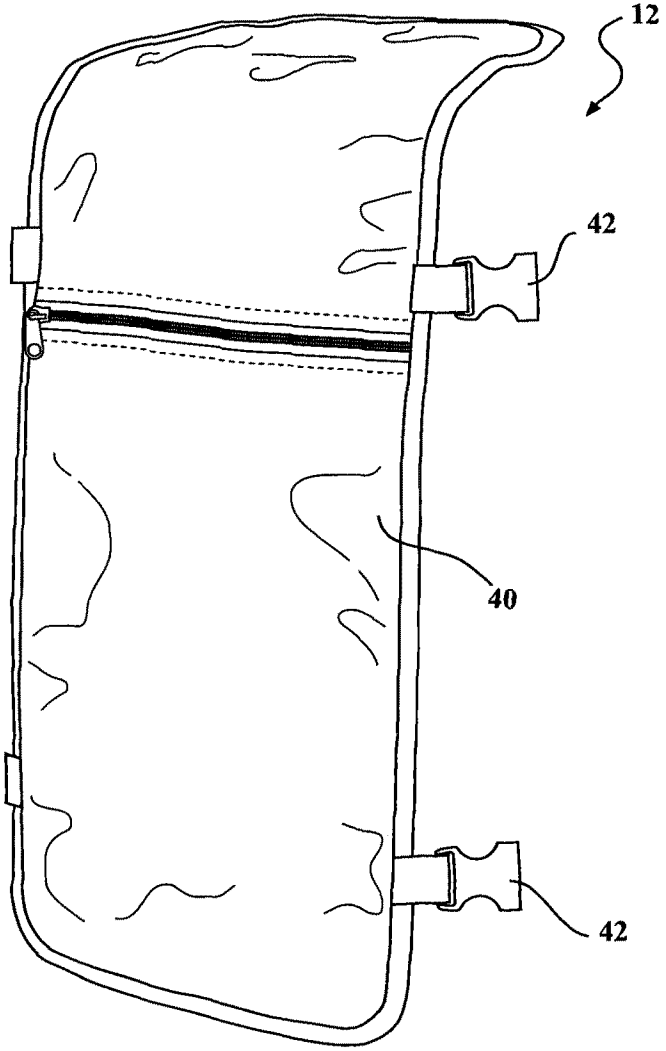
FIG. 7 is a schematic perspective view of another side of the removable panel illustrated in FIGS. 1-4 and 6.

As best seen in FIGS. 1, 2, and 7, the removable panel 12 also comprises a second side 40 opposing the first side 38. The second side 40 acts as the face of the backpack 10 when the removable panel 12 is coupled to the backpack 10. As such, the second side 40 may be customized and stylized based on the user's preferences. In this embodiment, the removable panel 12 includes one or more buckles 42 extending radially outward from the perimeter of the removable panel 12. The buckles 42 are configured to engage with the locking clips 34 on the backpack 10. The buckles 42 and the locking clips 34 may be fabricated from any type of material and may have any shape or configuration so long as the locking clips 34 may mate with the buckles 42.

For example, the second side 40 of the removable panel 12 may include a design, such as a logo, a pattern, or artwork. The design may be used to promote a sports team, business, university, etc. The second side 40 may be coupled to a variety of different bags. For example, the second side 40, as depicted in FIGS. 1, 2, and 7, may be coupled to the backpack 10 when the backpack 10 is used for work. A user may then convert the backpack 10 for a different purpose/activity by either changing the design on the existing removable panel 12 or replacing the removable panel. In some examples, the user may choose a removable panel that matches (or does not match) the color, design, fabric, etc. of the rest of the backpack 10.

In the embodiment seen in FIGS. 1-4, the first side 38 of the removable panel 12 is coupled to the front side 14 of the backpack 10 using the VELCRO® strips 44, 50, 56 and the locking clips 34 inserted into the buckles 42. In this embodiment, two locking clips 34 are inserted into two buckles 42 on each of the left and right sides 18, 20 of the backpack 10. In other embodiments, the removable panel 12 may be coupled to the backpack 10 using either the VELCRO® strips 44, 50, 56 or the locking clips 34 inserted into the buckles 42.

In an embodiment, the removable panel 12 covers the entire front side 14 and the entire top portion 22 of the backpack 10 by attaching to the respective VELCRO® strips 44, 50 thereon. As a result, a portion of the removable panel 12 overlays the second zipper 32. In another embodiment, the removable panel 12 only covers a portion of the front side 14 of the backpack 10 and does not overlay the second zipper 32. The removable panel 12 may be readily decoupled from the front side 14 of the backpack 10 by releasing each of the locking clips 34 from the buckles 42 and/or by pulling the removable panel 12 off the VELCRO® strips 44, 50.

The removable panel 12 may be selectively coupled to the front side 14 of the backpack 10 through a variety of means, including, but not limited to one or more fasteners, magnets, clasps, clamps, hooks, buckles, snaps, zippers, buttons, VELCRO®, or the like.

Figure 9:
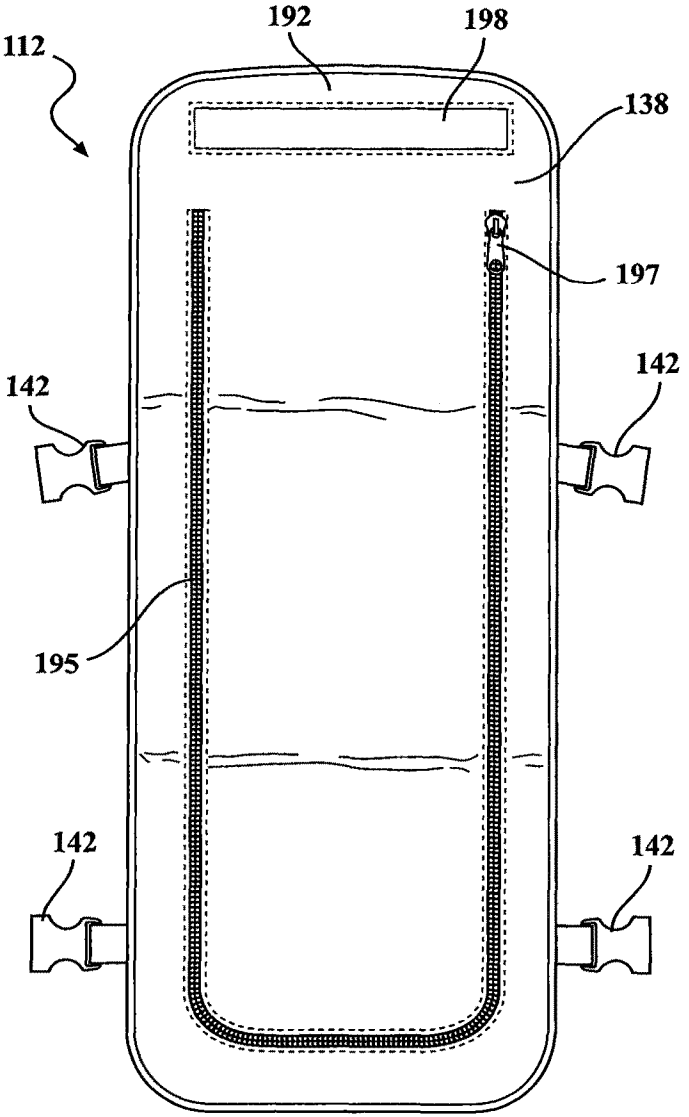
FIG. 9 is a schematic elevation view of a removable panel that couples with the backpack illustrated in FIG. 8.
Figure 8:
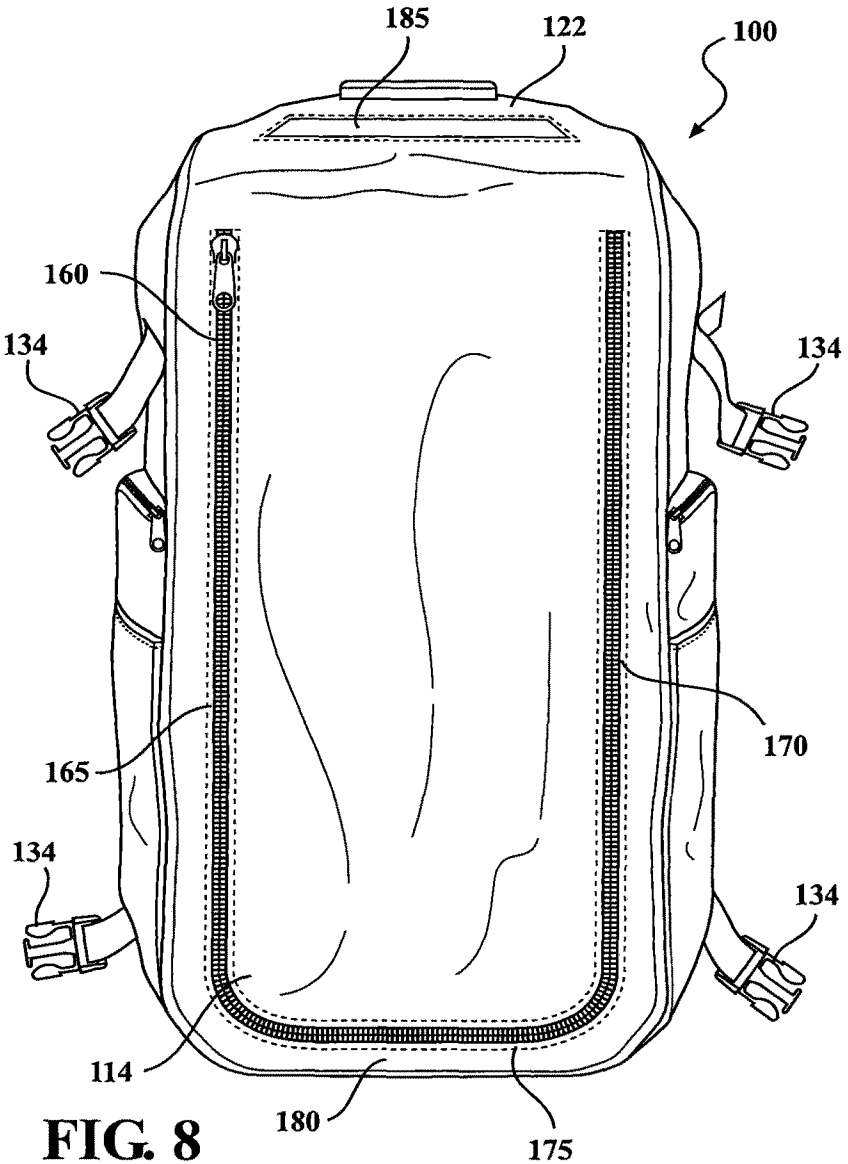
FIG. 8 is a schematic front elevation view of a backpack according to an alternative embodiment of the disclosure.

FIGS. 8 and 9 illustrate views of a backpack 100 according to a second embodiment of the disclosure. The backpack 100 is similar to the backpack 10 depicted in FIGS. 1-5, but does not comprise any VELCRO® strips. Instead, the backpack 100 in this embodiment includes a first set of zipper teeth 160 positioned on an exterior surface of a front side 114 of the backpack 100, as shown in FIG. 8.

The first set of zipper teeth 160 may be arranged in a "U-shaped" configuration having a first segment 165, a second segment 170, and a third segment 175. The first segment 165 is parallel to and has substantially the same length as the second segment 170. Each of the segments 165, 170 extend vertically through the exterior surface of the front side 114. The third segment 175 is interposed between the first and second segments 165, 170 and extend substantially horizontally across a lower portion 180 of the front side 114. One of ordinary skill in the art would understand that the first set of zipper teeth 160 may have a variety of shapes and configurations.

As seen in FIG. 8, a first magnet 185, such as a permanent magnet, may be positioned within an exterior surface on a top portion 122 of the backpack 100. The first magnet 185 may be inserted within the fabric/material of the top portion 122 using a variety of techniques, such as sewing, gluing, taping, etc. In this embodiment, the first magnet 185 is substantially parallel with the third segment 175 and interposed between the first and second segments 165, 170 of the first set of zipper teeth 160. One of ordinary skill in the art would understand that the first magnet 185 may also be inserted within the fabric/material in other portions of the top portion 122. In an alternative embodiment, the first magnet 185 may be positioned on the front side 114 of the backpack 100.

FIG. 9 illustrates a removable panel 112 that is configured to couple with the backpack 100. The removable panel 112 comprises a first side 138 including a second set of zipper teeth 195 attachable to the first set of zipper teeth 160. The second set of zipper teeth 195 may be arranged in a "U-shaped" configuration to align with the configuration of the first set of zipper teeth 160. One of ordinary skill in the art would understand that the second set of zipper teeth 195 may have a variety of shapes and configurations.

A zipper slider 197 is coupled to the second set of zipper teeth 195. The zipper slider 197 is coupled to the first set of zipper teeth 160 upon attachment of the first set of zipper teeth 160 to the second set of zipper teeth 195.

In the embodiment shown in FIG. 9, the first side 138 of the removable panel 112 also includes a second magnet 198, such as a permanent magnet, positioned within the fabric/material on an upper portion 192 of the first side 138. It may be positioned within the upper portion 192 using a variety of techniques, such as sewing, gluing, taping, etc. The first magnet 185 on the backpack 100 may be the same magnet as the second magnet 198 or a different magnet.

The front side 114 includes one or more locking clips 134 extending outward therefrom. Even though there are four locking clips 134 in the embodiment shown in FIG. 8, less than four and more than four locking clips 134 are possible in other embodiments. The locking clips 134 are configured to engage with one or more buckles 142 extending radially outward from the perimeter of the removable panel 112. Even though there are four buckles 142 in the embodiment shown in FIG. 9, less than four and more than four buckles 142 are possible in other embodiments.

The removable panel 112 may be selectively coupled to the backpack 100 by aligning and coupling the first set of zipper teeth 160 with the second set of zipper teeth 195 and/or connecting the first magnet 185 with the second magnet 198 through the fabric and/or engaging the locking clips 134 with the buckles 142. When the first set of zipper teeth 160 are coupled with the second set of zipper teeth 195, the zipper slider 197 may be used to zip the removable panel 112 to and unzip the removable panel 112 from the backpack 100. The attraction between the first magnet 185 and the second magnet 198 allows the upper portion 192 of the first side 138 of the removable panel 112 to mate with the top portion 122 of the backpack 100.

Figure 11:
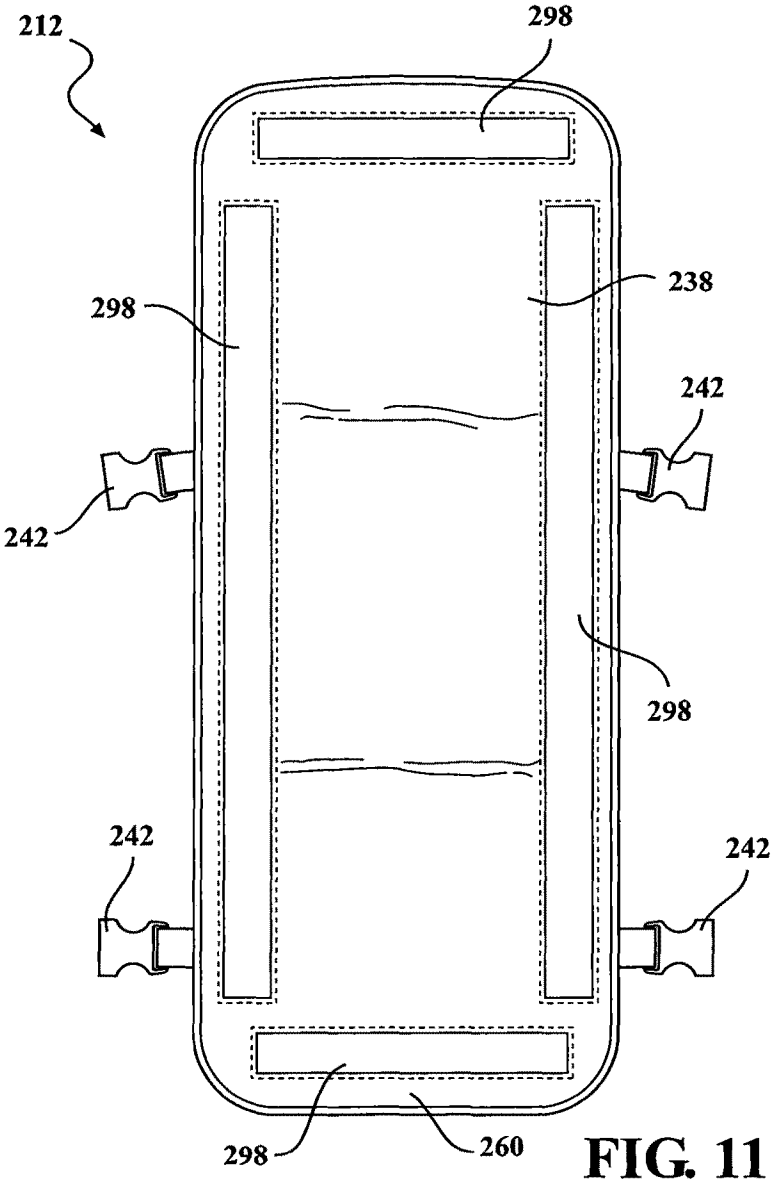
FIG. 11 is a schematic elevation view of a removable panel that couples with the backpack illustrated in FIG. 10.
Figure 10:
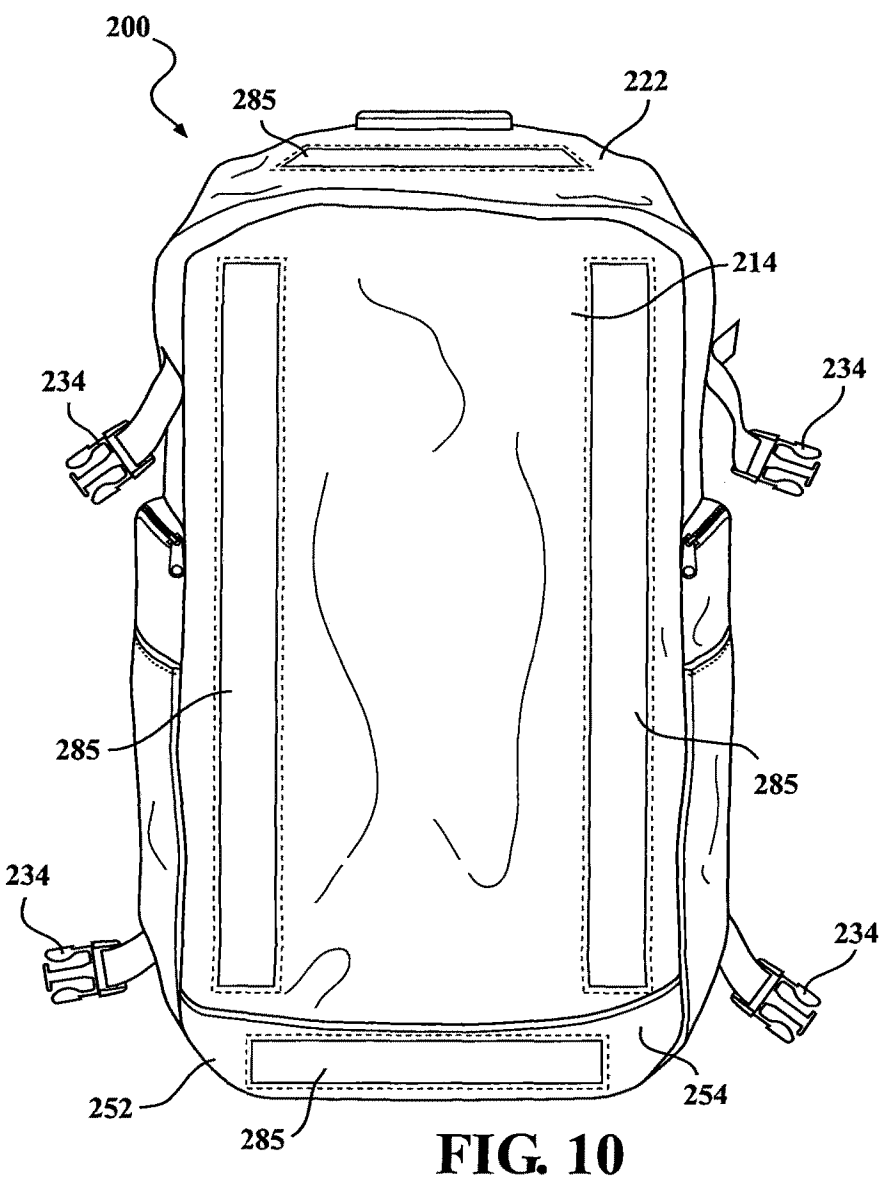
FIG. 10 is a schematic front elevation view of a backpack according to another alternative embodiment of the disclosure.

FIGS. 10 and 11 illustrate views of a backpack 200 according to a third embodiment of the disclosure. The backpack 200 is similar to the backpacks 10, 100 depicted in FIGS. 1-5 and 8. As seen in FIG. 10, the backpack 200 includes a front side 214 having a plurality of first magnets 285, such as permanent magnets. The first magnets 285 may be positioned in various locations in the fabric/material of the front side 214. Each of the first magnets 285 may be inserted within the fabric/material of the backpack 200 using a variety of techniques, such as sewing, gluing, taping, etc.

In the embodiment shown in FIG. 10, four of the first magnets 285 may be inserted within the fabric/material of the backpack 200. For example, two of the first magnets 285 may be inserted within the fabric/material on opposing corners of the front side 214 in order to maximize the effectiveness/strength of the first magnets 285. A third of the first magnets 285 may be inserted within the fabric/material in a top portion 222 of the backpack 200, wherein this magnet 285 is perpendicular to the other two other magnets 285 positioned on the front side 214. Yet another of the first magnets 285 may be inserted within the fabric/material in a flap portion 254 positioned on a bottom portion 252 of the front side 214. The first magnet 285 positioned in the flap portion 254 may be substantially parallel to the first magnet 285 positioned within the top portion 222.

FIG. 11 illustrates a removable panel 212 that is configured to couple with the backpack 100. The removable panel 212 comprises a first side 238 including a plurality of second magnets 298, such as permanent magnets. The second magnets 298 may be positioned in various locations in the fabric/material of the first side 238. Each of the second magnets 298 may be inserted within the fabric/material of the removable panel 212 using a variety of techniques, such as sewing, gluing, taping, etc.

As shown in FIG. 11, four of the second magnets 298 may be inserted within the fabric/material of the first side 238 to align with the first magnets 285 positioned on the rest of backpack 200. For example, two of the second magnets 298 may be inserted within the fabric/material on opposing corners of the first side 238 in order to maximize the effectiveness/strength of the second magnets 298. A third of the second magnets 298 may be inserted within the fabric/material in an upper portion 292 of the first side 238. Yet another of the second magnets 298 may be inserted within the fabric/material in a lower portion 260 of the first side 238 such that it is substantially parallel to the second magnet 298 positioned in the upper portion 292 of the first side 238. One of ordinary skill in the art would understand that the amount and positioning of the first magnets 285 and the second magnets 298 may vary in other embodiments.

The front side 214 also includes one or more locking clips 234 extending outward therefrom. Even though there are four locking clips 234 in the embodiment shown in FIG. 10, less than four and more than four locking clips 234 are possible in other embodiments. The locking clips 234 are configured to engage with one or more buckles 242 extending radially outward from the perimeter of the removable panel 212. Even though there are four buckles 242 in the embodiment shown in FIG. 11, less than four and more than four buckles 242 are possible in other embodiments.

The removable panel 212 may be selectively coupled to the rest of the backpack 200 by aligning and attracting each of the first magnets 285 with each of the second magnets 298 and/or engaging the locking clips 234 with the buckles 242.

FIGS. 12-15 illustrate views of a backpack 300 according to a fourth embodiment of the disclosure. As seen in FIGS. 12-14, the backpack 300 includes a front side 314, a back side 316 that generally opposes the front side 314. The backpack 300 also includes opposing left and right sides 318, 320, a top portion 322, and a bottom portion (not shown). In this embodiment, the backpack 300 includes a removable panel 312 coupled to the right side 320.

As best seen in FIG. 13 and as a non-limiting example, the backpack 300 includes adjustable shoulder straps 326 that extend across the back side 316.

In an alternative embodiment, the removable panel 312 may be coupled to the left side 318. In another alternative embodiment, a first removable panel may be coupled to the right side 320 and a second removable panel may be coupled to the left side 318 on the backpack 300. In yet another alternative embodiment, a first removable panel may be coupled to the right side 320 or the left side 318 and a second removable panel may be coupled to the front side 314, wherein the front side 314 may also include one or more strips of VELCRO® (i.e. hook-and-loop fastener).

The removable panel 312 may be readily interchangeable with a variety of different bags depending on the user's preferences. In the embodiment shown in FIGS. 12, 13, and 15, the removable panel 312 is selectively coupled to an exterior surface of the right side 320 or the left side 318 of the backpack 300 using one or more VELCRO® (i.e. hook-and-loop fastener) strips 344 positioned on the left side 318 and/or the right side 320 and one or more VELCRO® (i.e. hook-and-loop fastener) strips 356 on a first side 338 of the removable panel 312. As a result, the first side 338 of the removable panel 312 may rest flush with the left side 318 and/or the right side 320 of the backpack 300 when coupled.

In the embodiment shown in FIG. 14, two parallels strips 344 of VELCRO® (i.e. hook-and-loop fasteners) extend vertically along at least a portion of the right side 320. In another embodiment, two parallels strips 344 of VELCRO® (i.e. hook-and-loop fasteners) extend vertically along at least a portion of the left side 318. In yet another embodiment, two parallels strips 344 of VELCRO® (i.e. hook-and-loop fasteners) extend vertically along each of the right side 320 and left side 318 of the backpack 300. One of ordinary skill in the art would understand that there may just one strip of VELCRO® (i.e. hook-and-loop fastener) or more than two strips of VELCRO® (i.e. hook-and-loop fasteners) on the right side 320 and/or the left side 318 of the backpack 300 in other embodiments. Also, one of ordinary skill in the art would understand that the orientation and location of the strips of VELCRO® (i.e. hook-and-loop fasteners) on the sides of the backpack 300 may vary in other embodiments.

As best seen in FIG. 14, the strips 344 of VELCRO® (i.e. hook-and-loop fasteners) extends along the entire length of the right side 320. The top portion 322 may also include one or more strips VELCRO® (i.e. hook-and-loop fasteners). In the embodiment shown in FIG. 14, a bottom strip 350 of VELCRO® (i.e. hook-and-loop fastener) is positioned below and perpendicular to the strips 344 on the right side 320 of the backpack 300. One of ordinary skill in the art would understand that the bottom strip 350 may also be positioned on the left side 318. In an alternative embodiment, neither the right side nor the left side includes a bottom strip.

As best seen in FIG. 15, the first side 338 of the removable panel 312 may comprise VELCRO® (i.e. hook-and-loop fastener) strips 356 that are configured to mate with the one or more of the VELCRO® (i.e. hook-and-loop fastener) strips 344 on the right side 320 and/or the left side 314 of the backpack 300. In the embodiment shown in FIG. 15, there is a set of parallel VELCRO® (i.e. hook-and-loop fasteners) strips 356A arranged along the outer portions of the first side 338 of the removable panel 312 and a VELCRO® (i.e. hook-and-loop fastener) strip 356B positioned below and perpendicular to the VELCRO® (i.e. hook-and-loop fasteners) strips 356A. One of ordinary skill in the art would understand that the location and quantity of VELCRO® (i.e. hook-and-loop fastener) strips on the first side 338 of the removable panel 312 may vary in other embodiments.

As best seen in FIGS. 12, the removable panel 12 also comprises a second side 340 opposing the first side 338. The second side 340 acts as the face of the backpack 300 when the removable panel 312 is coupled to the backpack 300. As such, the second side 340 may be customized and stylized based on the user's preferences.

In an alternative embodiment, the removable panel 312 may include one or more buckles extending radially outward from the perimeter of the removable panel 312. The buckles may be configured to engage with locking clips on the backpack 300. The buckles and the locking clips may be fabricated from any type of material and may have any shape or configuration so long as the locking clips may mate with the buckles.

As best seen in FIG. 12, the removable panel 312 is coupled to the right side 320 of the backpack 300 using the one or more strips 344 of VELCRO® (i.e. hook-and-loop fastener). In alternative embodiments, locking clips and/or buckles on the backpack 300 may be used in addition to (or instead of) the one or more strips 344 of VELCRO® (i.e. hook-and-loop fastener) to couple the first side 338 of the removable panel 312 to the right side 320 of the backpack 300. The same applies for the left side 318 of the backpack 300.

The removable panel 312 may be selectively coupled to the left side 318 and/or the right side 320 of the backpack 300 through a variety of means, including, but not limited to one or more fasteners, magnets, clasps, clamps, hooks, buckles, snaps, zippers, buttons, VELCRO® (i.e. hook-and-loop fastener), or the like.

It is to be understood that the various embodiments described in this specification and as illustrated in the attached drawings are simply exemplary embodiments illustrating the inventive concepts as defined in the claims. As a result, it is to be understood that the various embodiments described and illustrated may be combined from the inventive concepts defined in the appended claims.

In accordance with the provisions of the patent statutes, the present disclosure has been described to represent what is considered to represent the preferred embodiments. However, it should be noted that this disclosure can be practiced in other ways than those specifically illustrated and described without departing from the spirit or scope of this disclosure.

What is claimed is:

1. A combination backpack and removeable panel comprising:

a backpack having an upwardly-facing top side substantially covering the top of the backpack, the top side having a horizontal width, a first fastener overlying the top side;

the backpack having a bottom side opposite the top side, the bottom side substantially covering the bottom of the backpack;

the backpack having an outwardly-facing front side extending vertically between the top and bottom sides, the front side substantially covering the front of the backpack, the front side having a horizontal width and a vertical height;

the backpack having a back side opposite the front side, the back side substantially covering the back of the backpack, the back side extending vertically between the top and bottom sides, at least one shoulder strap overlying the back side;

the backpack having a left side extending vertically between the top and bottom sides and extending horizontally between the front and back sides, the left side substantially covering the left side of the backpack, and an opposing right side extending vertically between the top and bottom sides and extending horizontally between the front and back sides, the right side substantially covering the right side of the backpack, one or more second fasteners overlying at least one of the left side and the right side;

the top and bottom and front and back and right and left sides forming an enclosure of the backpack;

a removable panel selectively engageable with and entirely disengageable from the backpack, the removeable panel having a top edge and a bottom edge and opposing side edges, the removeable panel having a width between the opposing side edges generally equal to the width of the front side of the backpack, the removeable panel having a height between the top and bottom edges that is greater than the vertical height of the front side of the backpack, and wherein the removeable panel includes one or more third fasteners;

wherein the third fasteners on the removable panel are selectively engaged with one or more of the first fasteners and with the one or more of the second fasteners; and wherein at least a portion of the first side of the removable panel extends over at least a portion of the top side, and the bottom edge of the removeable panel is aligned with the bottom side of the backpack and the removeable panel completely covers the front side of the backpack and extends at least partially over the top side of the backpack without covering any portion of the bottom and back and left and right sides of the backpack.

2. The combination of claim 1, wherein the back side includes a plurality of locking clips, and wherein the locking clips are selectively engaged with a plurality of buckles on the removable panel.

3. The combination of claim 1, wherein the one or more first fasteners on the top side and the one or more second fasteners each comprise strips of hook-and-loop fastener.

4. The combination of claim 3, wherein the third fasteners on the removable panel comprise strips of hook-and-loop fastener, and wherein the strips of hook-and-loop fastener are affixed to the strips of hook-and-loop fastener on the top side and to the strips of hook-and-loop fastener on the front side.

5. The combination of claim 1, wherein each of the left side and the right side includes one or more pockets.

6. The combination of claim 1, wherein the one or more first fasteners on the top side each comprise one or more first magnets inserted therein.

7. The combination of claim 6, wherein the one or more second fasteners comprise a first set of zipper teeth.

8. The combination of claim 7, wherein the one of the third fasteners on the removable panel comprise a second magnet inserted therein and another of the third fasteners comprises a second set of zipper teeth, and wherein a zipper slider is coupled to the second set of zipper teeth.

9. The combination of claim 8, wherein the first set of zipper teeth is engaged with the second set of zipper teeth using the zipper slider.

10. The combination of claim 8, wherein the first magnet is aligned with and attracted to the second magnet.

11. The combination of claim 1, wherein the one or more first fasteners on the top side each comprise a first magnet inserted therein and the one or more second fasteners each comprise a second magnet inserted therein.

12. The combination of claim 11, wherein the third fasteners on the removable panel each comprise a third magnet inserted therein.

13. A combination shoulder-carried bag and removeable panel comprising:

a shoulder-carried bag having an upwardly-facing top side substantially covering the top of the shoulder-carried bag, the top side having a horizontal width, a first fastener overlying the top side;

the shoulder-carried bag having a bottom side opposite the top side, the bottom side substantially covering the bottom of the shoulder-carried bag;

the shoulder-carried bag having an outwardly-facing front side extending vertically between the top and bottom sides, the front side substantially covering the front of the shoulder-carried bag, the front side having a horizontal width and a vertical height;

the shoulder-carried bag having a back side opposite the front side, the back side substantially covering the back of the shoulder-carried bag, the back side extending vertically between the top and bottom sides, at least one shoulder strap overlying the back side;

the shoulder-carried bag having a left side extending vertically between the top and bottom sides and extending horizontally between the front and back sides, the left side substantially covering the left side of the shoulder-carried bag, and an opposing right side extending vertically between the top and bottom sides and extending horizontally between the front and back sides, the right side substantially covering the right side of the shoulder-carried bag, one or more second fasteners overlying at least one of the left side and the right side;

the top and bottom and front and back and right and left sides forming an enclosure of the shoulder-carried bag;

a removable panel selectively engageable with and entirely disengageable from the shoulder-carried bag, the removeable panel having a top edge and a bottom edge and opposing side edges, the removeable panel having a width between the opposing side edges generally equal to the width of the front side of the shoulder-carried bag, the removeable panel having a height between the top and bottom edges that is greater than the vertical height of the front side of the shoulder-carried bag, and wherein the removeable panel includes one or more third fasteners;

wherein the third fasteners on the removable panel are selectively engaged with one or more of the first fasteners and with the one or more of the second fasteners; and wherein at least a portion of the first side of the removable panel extends over at least a portion of the top side, and the bottom edge of the removeable panel is aligned with the bottom side of the shoulder-carried bag and the removeable panel completely covers the front side of the shoulder-carried bag and extends at least partially over the top side of the shoulder-carried bag without covering any portion of the bottom and back and left and right sides of the shoulder-carried bag.

14. The combination of claim 13, wherein the back side includes a plurality of locking clips, and wherein the locking clips are selectively engaged with a plurality of buckles on the removable panel.

15. The combination of claim 13, wherein the one or more first fasteners on the top side and the one or more second fasteners each comprise strips of hook-and-loop fastener.

16. The combination of claim 15, wherein the third fasteners on the removable panel comprise strips of hook-and-loop fastener, and wherein the strips of hook-and-loop fastener are affixed to the strips of hook-and-loop fastener on the top side and to the strips of hook-and-loop fastener on the front side.

17. The combination of claim 13, wherein each of the left side and the right side includes one or more pockets.

18. The combination of claim 13, wherein the one or more first fasteners on the top side each comprise one or more first magnets inserted therein.

19. The combination of claim 13, wherein the one or more first fasteners on the top side each comprise a first magnet inserted therein and the one or more second fasteners each comprise a second magnet inserted therein.

* * * * *